United States Patent [19]

Beige

[11] Patent Number: 4,930,052

[45] Date of Patent: May 29, 1990

[54] ILLUMINABLE JEWELRY ITEM

[75] Inventor: Joel Beige, East Hills, N.Y.

[73] Assignee: Rubie's Costume Co

[21] Appl. No.: 365,481

[22] Filed: Jun. 13, 1989

[51] Int. Cl.[5] ..... F21L 15/08

[52] U.S. Cl. ..... 362/104; 362/191

[58] Field of Search ..... 362/103, 104, 800, 191

[56] References Cited

U.S. PATENT DOCUMENTS

| | | | |
|---|---|---|---|
| 2,816,284 | 12/1957 | Campanell | 362/103 |
| 3,624,384 | 11/1971 | Ledingham | 362/104 |
| 3,805,047 | 4/1974 | Dockstader | 362/104 |
| 4,101,955 | 7/1978 | Dunah | 362/104 |
| 4,215,388 | 7/1980 | Reimann | 362/104 |

*Primary Examiner*—James C. Yeung

[57] ABSTRACT

An illuminable earring includes a housing having a slit-like opening; an earring support for hanging the housing from an ear of a person; a printed circuit board in the housing; a light bulb positioned on the printed circuit board; a power supply positioned on the printed circuit board for supplying power to the light bulb, the power supply including a battery, and a contact in electrical contact with the battery for supplying power from the battery to the light bulb; a pulse circuit connected between the power supply and the light bulb for supplying pulses of power from the power supply to the light bulb; and a thin non-conductive strip of plastic extendible through the opening in the housing and insertable between the battery and the contact for selectively interrupting the supply of power from the power supply to the light bulb.

1 Claim, 2 Drawing Sheets

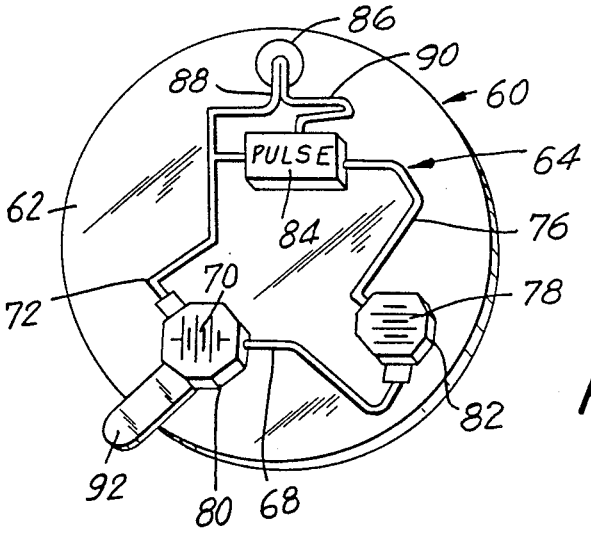
FIG. 4
FIG. 5
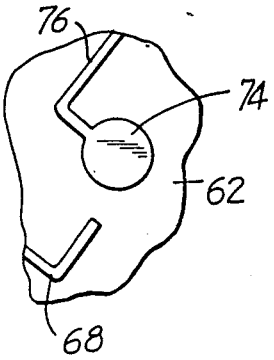
FIG. 6
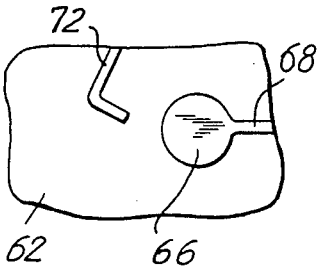
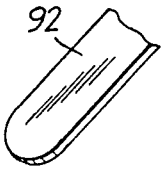
FIG. 7

ILLUMINABLE JEWELRY ITEM

BACKGROUND OF THE INVENTION

This invention relates generally to jewelry items, and more particularly, is directed to an illuminable earring.

Although it would be desirable to provide an illuminated jewelry item, a problem that arises is that the battery used therewith would always be on. As a result, it would become necessary to change the battery too often. Further, conventional switches are too bulky and heavy for use with a jewelry item such as an earring. An inexpensive, lightweight electric switch is thus highly desirable.

OBJECTS AND SUMMARY OF THE INVENTION

Accordingly, it is an object of the present invention to provide an illuminable jewelry item that overcomes the aforementioned problems.

It is another object of the present invention to provide an illuminable jewelry item having pulse means for pulsing a light source therein.

It is still another object of the present invention to provide an illuminable jewelry item in which power to the light source can be interrupted by a switch.

It is yet another object of the present invention to provide an illuminable jewelry item in which the switch is a removable thin strip of non-conductive plastic that interrupts current to the light source.

It is a further object of the present invention to provide such an illuminable jewelry item in the form of an earring.

It is a still further object of the present invention to provide such an illuminable jewelry item that is inexpensive and easy to manufacture and operate.

In accordance with an aspect of the present invention, an illuminable jewelry item includes a housing; illumination means positioned in the housing for supplying light; power supply means positioned in the housing for supplying power to the illumination means; and non-conductive switch means insertable between the power supply means and the illumination means for selectively interrupting the supply of power from the power supply means to the illumination means.

In accordance with another aspect of the present invention, an illuminable jewelry item includes a housing; illumination means positioned in the housing for supplying light; power supply means positioned in the housing for supplying power to the illumination means; pulse means connected between the power supply means and the illumination means for supplying pulses of power from the power supply means to the illumination means; and non- conductive switch means insertable between the power supply means and the illumination means for selectively interrupting the supply of power from the power supply means to the illumination means.

In accordance with still another aspect of the present invention, an illuminable jewelry item includes a housing having an opening; illumination means positioned in the housing for supplying light; power supply means positioned in the housing for supplying power to the illumination means; pulse means connected between the power supply means and the illumination means for supplying pulses of power from the power supply means to the illumination means; and non-conductive switch means extendible through the opening in the housing and between the power supply means and the illumination means for selectively interrupting the supply of power from the power supply means to the illumination means.

In accordance with yet another aspect of the present invention, an illuminable earring includes a housing having an opening; support means for hanging the housing from an ear of a person; illumination means positioned in the housing for supplying light; power supply means positioned in the housing for supplying power to the illumination means; pulse means connected between the power supply means and the illumination means for supplying pulses of power from the power supply means to the illumination means; and non-conductive switch means extendible through the opening in the housing and between the power supply means and the illumination means for selectively interrupting the supply of power from the power supply means to the illumination means.

The above and other objects, features and advantages of the present invention will become readily apparent from the following detailed description which is to be read in connection with the accompanying drawings.

BRIEF DESCRIPTION OF THE DRAWINGS

FIG. 4 is a perspective view of the circuitry of the illuminable earring of FIG. 1;

FIG. 5 is a top plan view of a portion of the printed circuit board of FIG. 4;

FIG. 6 is a top plan view of another portion of the printed circuit board of FIG. 4;

FIG. 7 is a perspective view of the non-conductive switch member shown in FIG. 4;

FIG. 8 is a perspective view of the housing of the illuminable earring ornament of FIG. 1 with the circuitry removed;

FIG. 9 is a top plan view of the printed circuit board receiving shell of the housing of FIG. 8;

FIG. 10 is an enlarged perspective view of a portion of the printed circuit board receiving shell of FIG. 9; and FIG. 11 is a block or schematic diagram of the circuitry of FIG. 4.

DETAILED DESCRIPTION OF A PREFERRED EMBODIMENT

Figure 1:
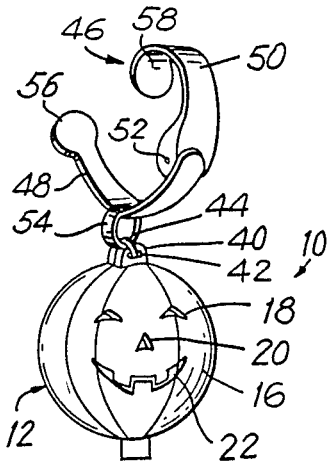
FIG. 1 is a front perspective view of an illuminable earring according to the present invention.
Figure 2:
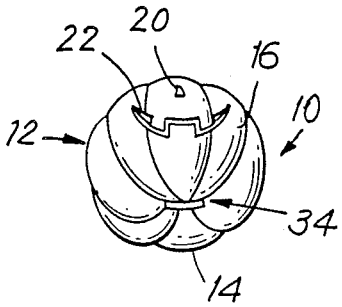
FIG. 2 is a bottom perspective view of the illuminable earring ornament of FIG. 1.
Figure 3:
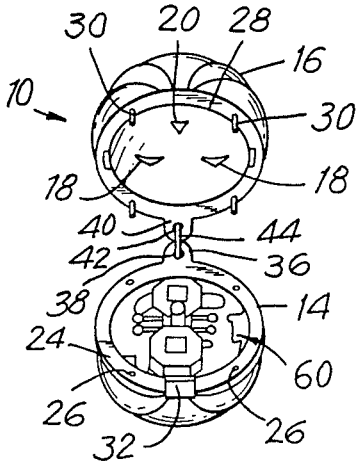
FIG. 3 is a perspective view of the illuminable earring ornament of FIG. 1 shown in an opened condition.

Referring to the drawings in detail, and initially to FIGS. 1–3 thereof, an illuminable earring 10 according to the present invention includes a housing 12 formed by two half shells 14 and 16, each of a substantially half-spherical configuration and defining a spherical enclosure with a chamber therebetween when the half shells are secured together. As will be appreciated from the discussion hereinafter, half shell 14 forms a circuit receiving part, while half shell 16 forms a cover. In this manner, a printed circuit board can be housed between half shells 14 and 16, as will be described in greater detail hereinafter. In a preferred embodiment of the present invention, half shells 14 and 16 have an orange color, and half shell 16 has cut-out eyes 18, a cut-out nose 20 and a cut-out mouth 22 so as to impart a pumpkin-like appearance to housing 12.

In order to releasably secure half shells 14 and 16 together, the circular peripheral wall 24 of half shell 16 is provided with a plurality of holes 26, and the circular peripheral wall 28 of half shell 14 is provided with a plurality of corresponding pins 30. Since half shells 14 and 16 are made of a plastic material, pins 30 are dimensioned to fit snugly in holes 26 with a releasable friction fit. In this manner, half shells 14 and 16 can be later pried apart to gain access to the inside of housing 12.

In addition, half shell 14 is provided with a recess 32 at peripheral wall 24 thereof, directly below cut-out mouth 22, so as to form a slit-like opening 34 in housing 12 when half shells 14 and 16 are assembled together, as best shown in FIG. 2.

In order to hang illuminable earring 10 from the ear of a person, and in order to prevent complete detachment of half shells 14 and 16 from each other, half shell 14 is provided with a tab 36 extending from the upper end thereof and having a surface which is coplanar with and, thereby an extension of peripheral wall 24. Tab 36 has a hole 38 extending therethrough at the free end thereof. In like manner, half shell 16 is provided with a tab 40 extending from the upper end thereof and having a surface which is coplanar with and, thereby an extension of, peripheral wall 28. Tab 40 has a hole 42 extending therethrough at the free end thereof. A metal ring 44 extends through holes 38 and 42 so as to secure half shells 14 and 16 together, even when pins 30 are not fit within holes 26.

An earring support 46 is connected with ring 44 for hanging housing 12 from an ear of a person. Support 46 can be any conventional support, and can be provided for a pierced ear or an unpierced ear. In the embodiment shown in FIG. 1, earring support 46 is provided for an unpierced ear. Specifically, earring support 46 is a clasp having a first clasp section 48 and a second clasp section 50 pivotally secured to first clasp section 48 by means of a pivot pin 52. First clasp section 48 includes a ring 54 secured thereto, ring 54 being engaged with ring 44 so as to support housing 12 from earring support 46. First clasp section 48 includes an enlarged head 56 at the free end thereof, and in like manner, second clasp section 50 includes an enlarged head 58 at the free end thereof, with enlarged heads 56 and 58 engaging on opposite sides of an ear lobe in a conventional manner. Further, a leaf spring arrangement (not shown) is provided at the pivoted ends of first and second clasp sections 48 and 50 to bias the same into an open condition, as shown in FIG. 1, or a closed condition (not shown) in which enlarged heads 56 and 58 engage opposite sides of an ear lobe with a spring force.

In accordance with the present invention, a printed circuit board 60 is provided in housing 12. Specifically, printed circuit board 60 is constructed as a thin plastic disc 62 having a printed wiring pattern 64 deposited or etched thereon. As shown best in FIGS. 4 and 6, printed wiring pattern 64 includes a first contact land 66 which is positioned in opposing relating to slit-like opening 34 when printed circuit board 60 is assembled in housing 12. A printed wire 68 extends from first contact land 66. A first U- shaped metal contact 70 is positioned on disc 62 directly over contact land 66 and spaced therefrom. A printed wire 72 is formed on disc 62 and is separated from first contact land 66, but is in electrical contact with first U-shaped metal contact 70.

As shown best in FIGS. 4 and 5, printed wiring pattern 64 further includes a second contact land 74, with a printed wire 76 extending from second contact land 74. A second U-shaped metal contact 78 is positioned on disc 62 directly over second contact land 74 and spaced therefrom. Printed wire 68 extends to a position near second contact land 74, and is in electrical contact with second U-shaped metal contact 78.

A first battery 80 is removably positioned between first contact land 66 and first U-shaped metal contact 70, and a second battery 82 is removably positioned between second contact land 74 and second U-shaped metal contact 78. In this manner, it will be appreciated that a series circuit for current flow is provided between printed wire 72 and printed wire 76.

As shown in FIGS. 4 and 11, printed wires 72 and 76 are also connected to a pulse circuit 84, which is conventional. Further, a light source such as a light bulb 86 is provided having a first lead 88 connected with printed wire 72 and a second lead 90 connected with pulse circuit 84.

With this circuit arrangement, batteries 80 and 82 supply current to light bulb 86 to illuminate the same. However, pulse circuit 84 periodically interrupts such current so as to provide that current is supplied to light bulb 86 in a pulsed manner. As a result, light bulb 86 is caused to periodically blink on and off.

In order to shut off light bulb 86 completely, the current to light bulb 86 must be terminated. In this regard, a thin plastic non-conductive strip 92, as best shown in FIGS. 4 and 7, can be slipped between battery 80 and first contact land 66 so as to block electrical contact therebetween. As a result, the circuit is broken, and current to light bulb 86 is terminated. It will therefore be appreciated that strip 92 functions as an inexpensive switch. Strip 92 is dimensioned to extend within slit-like opening 34 in housing 12 for this purpose.

In order to secure printed circuit board 60 within housing 12, half shell 14 is provided with two diametrically opposite posts 94 at the inner wall thereof. Each post 94 includes a notch 96 therein, near the upper end 98 thereof. In this manner, disc 62 can be deformed so as to bend about the upper ends 98 of posts 94, whereupon disc 62 springs back into notches 96 so as to be retained by posts 94.

It will be appreciated that various modifications can be made with the present invention. For example, although housing 12 has been shown with a pumpkin configuration, housing 12 can have any other suitable configuration. Also, variations can be provided on the circuit arrangement, as long as there is provision for a blinking light that can be turned off.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined in the appended claims.

What is claimed is:

1. An illuminable jewelry item comprising:

a housing having an opening defining a thin guide slit;

illumination means positioned in said housing for supplying light;

power supply means positioned in said housing for selectively supplying power to said illumination means;

thin, fully non-conductive switch means extendible through said guide slit of said opening in said housing between said power supply means and said illumination means for selectively interrupting the supply of power from said power supply means to said illumination means; and said switch means being fully detachable from said housing by pulling through said guide slit, and when so detached allowing said power supply means to contact and illuminate said illumination means.

* * * * *